United States Patent [19]

Geoffroy-Dechaume

[11] 4,340,251

[45] Jul. 20, 1982

[54] KNOCKDOWN SEATS OF FOLDED SHEET MATERIAL

[76] Inventor: Vincent Geoffroy-Dechaume, 5 Enclos de l'Abbaye, 78300 Poissy, France

[21] Appl. No.: 271,540

[22] Filed: Jun. 8, 1981

Related U.S. Application Data

[62] Division of Ser. No. 93,146, Nov. 9, 1979.

[30] Foreign Application Priority Data

Nov. 10, 1978 [FR] France ..... 78 31826

[51] Int. Cl.[3] ..... A47C 7/00

[52] U.S. Cl. ..... 297/440; 297/442; 248/174

[58] Field of Search ..... 297/440, 442, 16; 248/174

[56] References Cited

U.S. PATENT DOCUMENTS

| | | | |
|---|---|---|---|
| 2,512,171 | 6/1950 | Oom | 248/174 X |
| 2,806,514 | 9/1957 | Smith | 297/442 |
| 2,904,105 | 9/1959 | Holden | 297/442 |
| 2,940,513 | 6/1960 | Holden | 297/442 |
| 3,331,634 | 7/1967 | Harrison | 297/442 |
| 3,695,703 | 10/1972 | Notko | 297/442 |
| 3,837,719 | 9/1974 | Barron | 248/174 X |

*Primary Examiner*—Francis K. Zugel

*Attorney, Agent, or Firm*—James and Franklin

[57] ABSTRACT

A knockdown seat comprises a base member, a seat member and optionally a back member, the seat and back members being supported on the base member. The members are formed of foldable semi-rigid sheet material, such as cardboard, plastics material or sheet metal. In one embodiment the seat is a chair and the seat member and back member each comprise a single sheet folded into a triangular prism and the base member includes two side supports each comprising one sheet folded spirally. Slots in the edges of the sheets of the seat member and the back member double joint them in complementary slots in the upper edges of the side supports. In another embodiment the seat is a stool. The base member comprises one or two sheets having panels forming the support structure of the base member and flaps adapted to bear on the panels forming the seat member. Slots in the flaps and the upper edges of the panels define joints interlocking the seat structure. In either embodiment the seat may be knocked down for storage or transport and may serve as an advertising medium.

3 Claims, 12 Drawing Figures

FIG.7
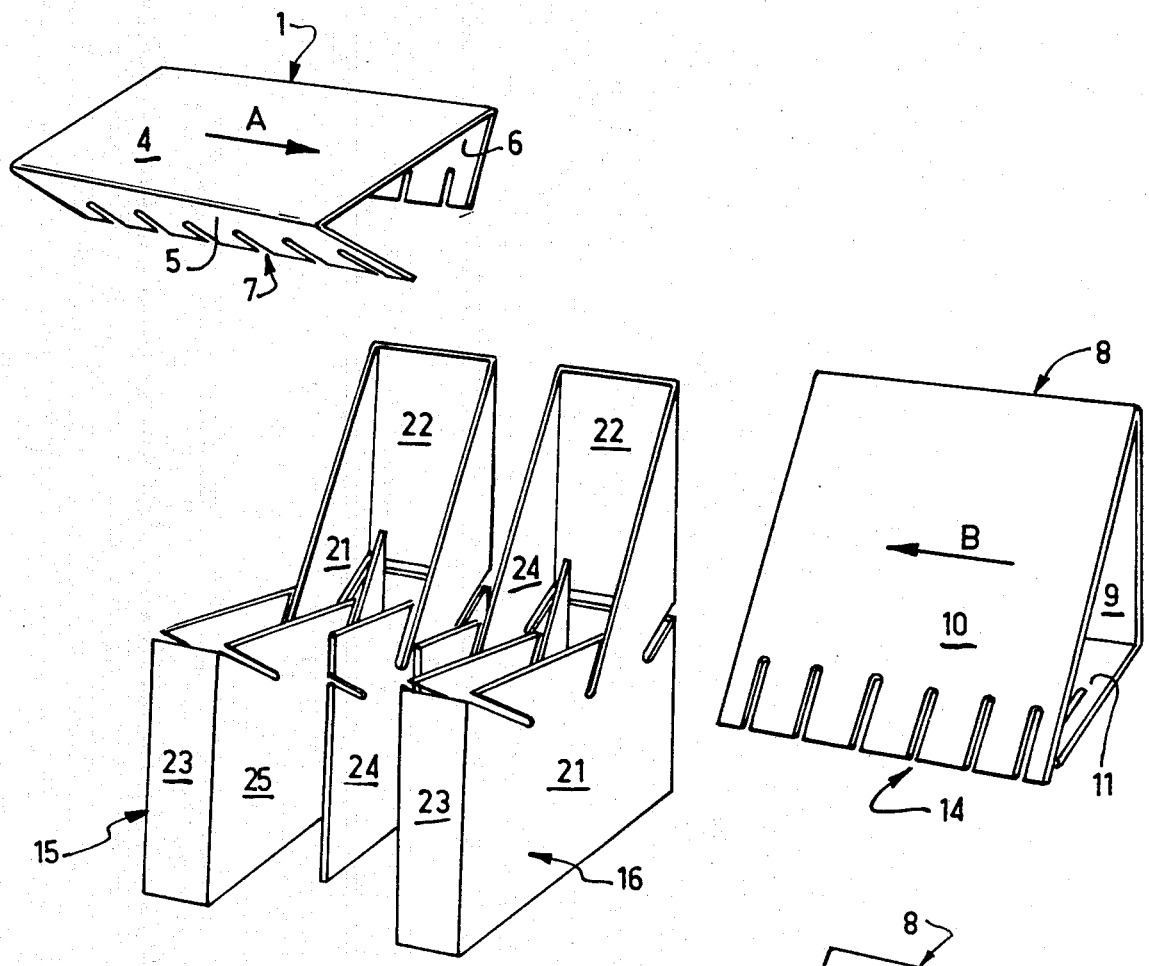
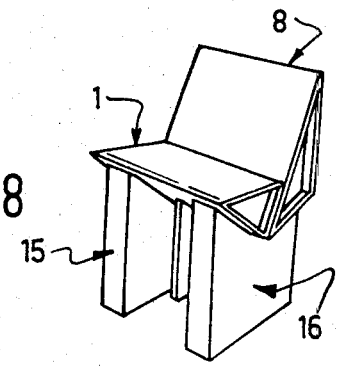
FIG.8

KNOCKDOWN SEATS OF FOLDED SHEET MATERIAL

This is a division, of application Ser. No. 06/093,146, filed Nov. 9, 1979.

BACKGROUND OF THE INVENTION

The present invention relates to knockdown seats made by assembling foldable sheet material.

The invention applies more particularly to extra chairs which, optionally, may be discarded.

Various seats of this type are already known, namely those in French Pat. No. 1,558,946 and U.S. Pat. No. 3,695,703, but these seats are either of unsturdy construction or of rather complex design necessitating an excessive amount of foldable material and generally include numerous and complicated cutouts which are incompatible with economical fabrication.

The object of the present invention is therefore the provision of a more rudimentary seat, hence less expensive, which is also easy to assemble and less space-consuming while being of sufficient strength to support the weight of an adult.

SUMMARY OF THE INVENTION

According to the invention there is provided a knockdown seat comprising a seat member and a base member, the seat member being supported on the base member and the base member being adapted to bear on the ground when the seat is assembled. The seat essentially consists of sheets of foldable material having complementary cutouts defining rabbeted joints for assembling the seat, the base member comprising at most two folded sheets of semi-rigid material adapted to bear edgewise, the sheet forming the seat member being interlocked with the sheet or sheets of the base member when the seat is assembled.

The seat according to the invention may embody a chair having a back member also. The back member and the seat member are each entirely comprised of single sheet, each having two parallel transverse fold hinges defining a central panel between two side flaps adapted to be folded toward each other to form a triangular prism. The base member comprises two identical elongated sheets, each divided by four transverse hinges into five panels or flaps which are adapted to be folded spirally, the sheets for the base member having slots adapted to receive the flaps of the sheets for the seat member and the back member to define rabbeted joints for interlocking the members together.

The seat according to the invention may embody a stool comprising only a seat member supported on a base member, the base member comprising at most two sheets having panels and flaps, the panels being essentially adapted to form the supporting structure of the base member and the flaps being adapted to bear against the panels to form the seat member, the panels and the flaps having cutouts defining rabbeted joints interlocking the flaps and the panels when the seat is assembled.

Preferably, when the seat embodies a stool, each sheet comprises a main panel of generally rectangular configuration subdivided by fold lines into a central panel and two side panels flanking the central panel, a first flap hinged along another side of the central panel and an end flap hinged to the first flap remote from the central panel, the edge of the end flap having two locking slots defining parts of the rabbeted joints.

The knockdown stool embodying the invention may be formed of two sheets of identical configuration united along their side margins or a single sheet folded over itself with its adjacent side margins united together.

BRIEF DESCRIPTION OF THE DRAWING

The invention will now be described in greater detail with reference to particular embodiments given by way of non-limiting example illustrated in the accompanying drawings, in which:

FIG. 7 is an exploded perspective view of all the members of the chair embodying the invention;

FIG. 8 illustrates a chair embodying the invention after assembling all the members of FIG. 7;

DETAILED DESCRIPTION OF THE PREFERRED EMBODIMENTS

Figure 1:
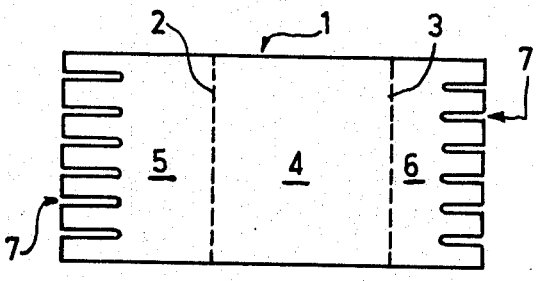
FIG. 1 is a top plan view of a sheet for the seat member of a chair embodying the invention.

As illustrated in FIG. 1 the seat member 1 of a chair embodying the invention essentially comprises a rectangular sheet of foldable semi-rigid material, such as a sheet of cardboard or plastics material, thin sheet metal, etc., this sheet comprising two parallel transverse fold lines or hinges 2 and 3 indicated by dashed lines which set off a central panel 4 flanked by two side flaps 5 and 6. The edges of the sheet 1, which form the sides of the flaps opposite to the corresponding fold lines, are notched and comprise six parallel equidistant slots 7, the widths of which are substantially equal to the thickness of the sheet.

Figure 2:
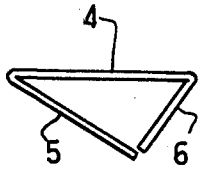
FIG. 2 is an end elevational view of a sheet for the seat member of FIG. 1 after it is folded.

On assembly the flaps 5 and 6 of the sheet 1 are folded toward each other so that their notched edges substantially meet so as to form a triangular prism (FIG. 2).

Figure 3:
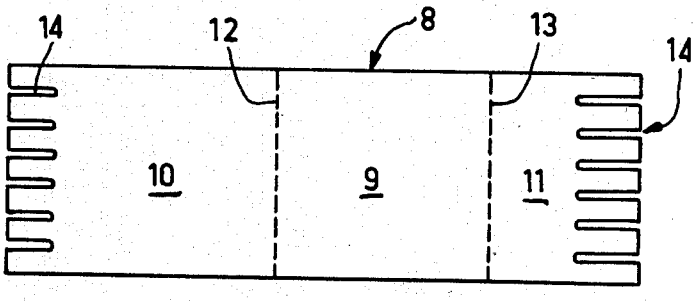
FIG. 3 is a top plan view of a sheet for the back member of the chair embodying the invention.

The sheet comprising the back member 8 of the chair (FIG. 3) resembles in all respects the sheet 1 which forms the seat member with the exception that it is substantially longer.

The sheet of the back member 8 also comprises a central panel 9 and two side flaps 10 and 11 joined to the central panel along two fold lines or hinges 12 and 13, the edges of the sheet 8 each also having six parallel equidistant slots 14 the widths of which are substantially equal to the thickness of the sheet. On assembly the flaps 10 and 11 are both folded toward each other so that their free edges meet (FIG. 4) to form a triangular prism.

Figure 5:
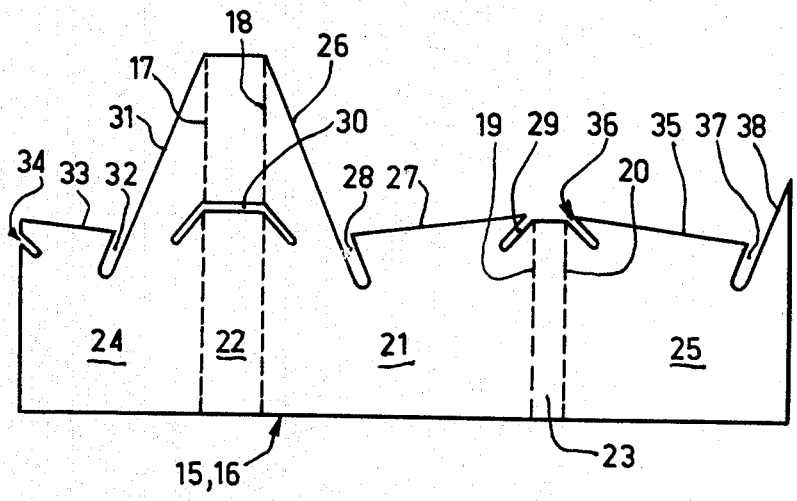
FIG. 5 is a front elevational view of a sheet adapted to form a side support of the chair embodying the invention.

As for the part of the chair which bears on the ground and supports the seat member, it essentially comprises two side supports 15 and 16, each formed from a sheet cut out to the contour shown in FIG. 5, which figure may serve to overcome any possible shortcomings of the description. The sheet of each support comprises four parallel fold lines or hinges 17,18,19 and 20 shown in dashed lines and defining a central panel 21 which will become one side of the chair, two side flaps 22 and 23 flanking the central panel and two end flaps 24 and 25 adapted to be folded parallel to the central panel.

The central panel 21 comprises three rectilinear sides of which two sides 18 and 19 are parallel and perpendicular to a third side, and a fourth side cut out according to the general configuration of a seat when viewed in profile, that is, it comprises a steeply sloping rectilinear portion 26 adapted to support the back member of the chair and an oppositely inclined gradually sloping portion 27 provided for supporting the seat member of the chair.

At the ends of portion 27 are cut out two slots 28 and 29 sloping toward each other in opposite directions, the forward slot 29 extending away from the fold line 19 and the rear slot 28 extending away from the fold line 18; slot 28 being in the continuation of the steeply sloping portion 26 and being twice as wide as the thickness of the sheet while the width of the slot 29 is equal to the thickness of the sheet.

An additional slot 30 is provided across panels 21, 22 and 24 substantially at level with the slot 29, slot 30 having a horizontal section dividing flap 22 into two separate, upper and lower, regions and two sloping sections symmetrical with respect to the vertical center line of the flap 22.

Flaps 22 and 23 are both rectangular, flap 22 having dimensions substantially twice as great as those of flap 23.

As for flaps 24 and 25 they in part repeat portions of the central panel 21, the flap 24 being a repetition of substantially half of the central panel 21 from the fold line 18 and the flap 25 being a repetition of four-fifths of the central panel 21 from the fold line 19. In other words, the flap 24 comprises three rectilinear sides, including two parallel vertical sides, a steeply sloping portion 31 extending downward by a slot 32 whose width is twice the thickness of the sheet, and a portion 33 gradually sloping in the opposite direction from the slot 32. The contour defined by portions 31,32 and 33 is symmetrical to the contour defined by portions 26,28 and 27 of panel 21 in relation to the vertical center line of the flap 22, apart from the fact that the portion 33 is only substantially half the length of portion 27 and has an extra slot 34 along its free vertical edge. As regards flap 25 other than the three rectilinear edges of which two are vertical and one horizontal, it comprises an upper edge formed by a gradually sloping portion 35 delimited at its ends by two oppositely sloping slots 36 and 37 and a steeply sloping portion 38 continuing upwardly from slot 37 the width of which is twice the thickness of the sheet. The contour defined by portions 35,36,37 and 38 is symmetrical to the contour defined by portions 27,29,28 and 26 of panel 21 in relation to the vertical center line of the intermediate flap 23, apart from the fact that the steeply sloping portion 38 is only substantially half the length of the steeply sloping portion 26 of the central panel 21.

On assembly (FIG. 6) flaps 22 and 23 are folded perpendicular to panel 21 to the same side thereof and flaps 24 and 25 are in turn folded toward each other perpendicular to their respective flaps 22 and 23 such that the sheet which forms a support is folded over itself with flaps 24 and 25 oriented parallel to the central panel 21, the longer panel 25 extending between panel 21 and flap 24 which partly overlies it. Depending on whether the flaps 22 and 23 are both folded over to one side or the other of the central panel 21 the ultimate support is either a right side support 15 (FIG. 6*a*) or a left side support 16 (FIG. 6*b*) of the chair.

Figure 4:
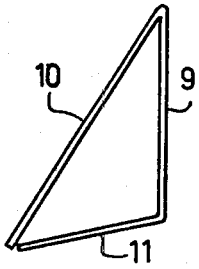
FIG. 4 is an end elevational view of the sheet for the back member of FIG. 3 after it is folded.
Figure 6:
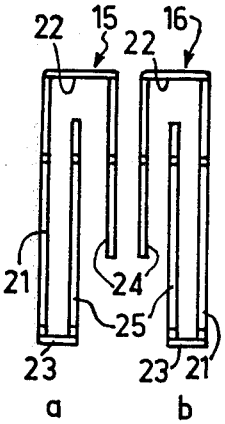
FIGS. 6*a* and 6*b* are top plan views of the right and left side supports respectively of a chair formed from the sheet shown in FIG. 5.

After the different sheets making up the seat member, the back member and the two side supports of the chair have been folded in conformity with FIGS. 2, 4 and 6 (folding being facilitated, namely for sheets of semirigid plastics material, by scoring them along the fold lines) the folded sheets are assembled very simply as illustrated in the exploded view of FIG. 7. The two side supports 15 and 16 being arranged side by side with their panels parallel, seat member 1 and back member 8 are positioned by sidewise translation in the directions of arrows A and B until the slots 7 and 14 are positioned facing the vertical panels of the side supports 15 and 16, which are jointed in the slots. Slots 28, 32 and 37 of each side support receives both flap 6 of the seat member 1 and flap 10 of the back member 8, i.e. a double thickness of sheet each, while slots 34,29 and 36 on the one hand and slot 30 on the other respectively receive the flap 5 of the seat member and flap 11 of the back member, i.e., a single thickness of sheet each.

Note that the members are double jointed since the slots 7 and 14 of the seat member and the back member receive the thicknesses of the sheets of the supports in the continuation of the slots thereof and slots of the side supports simultaneously receive the thicknesses of the sheet of the seat member and the back member in the continuation of the slots thereof.

After assembly and interlocking the various members together by mutual rabbeted jointing in their respective slots, the chair is as shown in FIG. 8. It will be noted that the fact of assembling the various members with only rabbeted joints and without any other bonding means, such as adhesives or staples, enables the chair to be easily taken apart whenever necessary.

Economical, easy to mass produce by cutting out the sheets by stamping, easy to assemble and disassemble, light but sufficiently sturdy, this chair is an excellent extra chair and easily transportable when knocked down. Furthermore, with the considerable visible surfaces it affords, it may be an excellent advertising medium as its very moderate production cost permits distribution in large quantities.

Moreover, this chair can also be a toy well appreciated by the children.

Of course, in case it is made of cardboard, the chair has a rather limited service life and it suffers wear and tear in time due to repeated stressing and impacts. It may then be discarded without any drawbacks owing to the fact the cardboard is biodegradable.

On the other hand if it is made of semirigid plastics material, hard rubber or sheet metal, it may be used indefinitely and its service life is comparable to that of any conventional piece of furniture.

Note that the chair embodying the invention may also be made of rigid sheet material, for example, plywood or transparent Plexiglass, independently forming each of the panels and flaps which make up the seat member, the back member or the side supports, the rigid panels and flaps being hinged together by flexible joints along the fold lines represented by dashed lines in the drawings.

Figure 11:
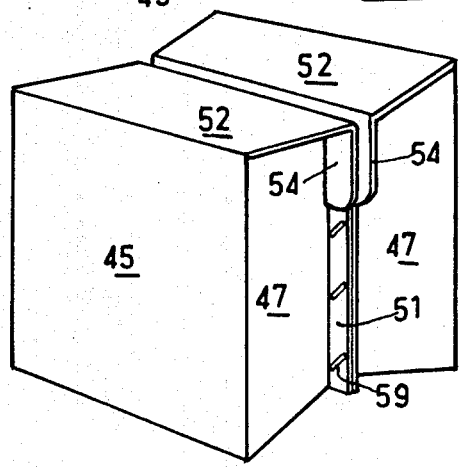
FIG. 11 illustrates, in perspective, the assembled stool.

In an alternative embodiment of the seat according to the invention, which is even more economical, the seat is in the form of a stool as illustrated in FIG. 11.

Figure 9:
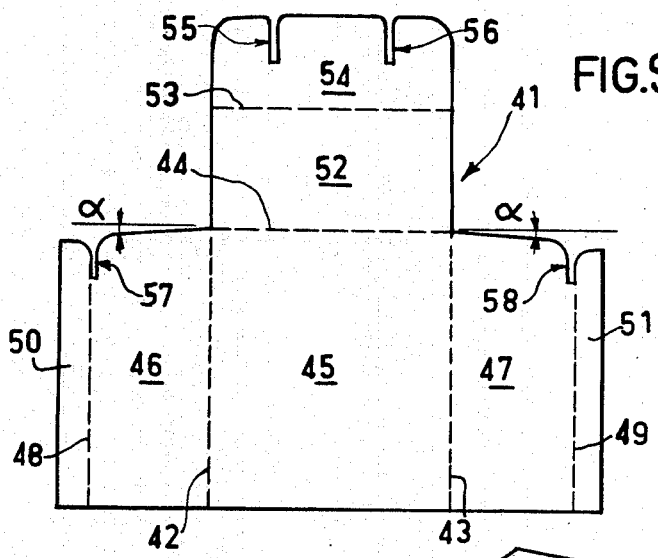
FIG. 9 is a front elevational view of a cutout sheet forming half of a stool embodying the invention.

The stool embodying the invention essentially comprises two identical cutout sheets the configuration of which is shown in FIG. 9. Each sheet 41 comprises a main panel of generally rectangular shape divided by two parallel fold lines or hinges 42 and 43 and a third perpendicular fold line or hinge 44 into a central panel 45 and two side panels 46 and 47. On the sides opposite the fold lines or hinges 42 and 43 side margins or flaps 50 and 51 are respectively jointed to the side panels 46 and 47 by parallel fold lines or hinges 48 and 49. Along fold line 44 a bendable flap 52 is joined to the central panel 45, the bendable flap 52 comprising along a fold line 53 opposite fold line 44 an end flap 54 joined thereto. The free edge of end flap 54 opposite fold line 53 is notched with two parallel locking slots 55 and 56. Likewise, side panels 46 and 47 respectively have notches 57 and 58 in the continuation of the fold lines 48 and 49. The upper, notched edges of panels 46 and 47 are not parallel to the lower edges thereof but slope slightly downward at an angle $\alpha$ to the opposite lower edges.

The stool embodying the invention is made with two identical sheets as described above. The sheets are superposed so that their respective contours are in perfect alignment and then their respective side flaps or margins 50 and 51 are connected together in pairs by staples 59 for example. The sheets are of semi-rigid material capable of being folded, such as heavy cardboard or plastics material or even thin sheet metal.

Figure 10:
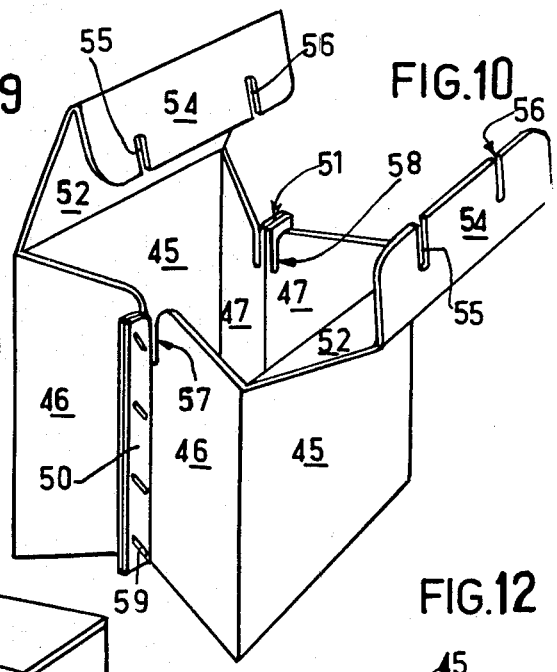
FIG. 10 illustrates the stool in the process of being assembled.
Figure 12:
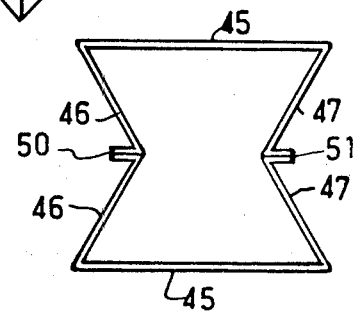
FIG. 12 illustrates a cross section of the stool of FIG. 11.

When the stool embodying the invention is knocked down, it is in the form of two superposed sheets lying flat. On assembly (FIG. 10) the side panels 46 and 47 are folded relative to the central panel 45 of each sheet 41 along fold lines 42 and 43 so that they define a cross section as shown in FIG. 12, i.e. a closed contour comprising two trapezoids joined by their small bases. The flaps 52 of each sheet 41 are then folded over along their fold lines 44 towards the interior of the closed contour defined by the two main panels joined by their side flaps or margins. The end flaps 54 are folded along fold lines 53 perpendicularly to flaps 52 and the slots 55 and 56 in the end flap 54 are brought into registry with slots 57 and 58 of the side panels 46 and 47 in such a way that the interlocking is produced by mutual engagement of the end flaps 54 in slots 57 and 58 and panels 46 and 47 in slots 55 and 56 of the end flaps. Thus interlocked the sheets are held folded and maintain the shape of the stool, its seat member being defined by the flaps 52 bearing on flaps 46 and 47.

The uniting and interlocking of the various panels and flaps together by rabbeted joints without any additional bonding means enables the stool to be assembled or knocked down whenever necessary.

Alternatively, a stool of identical shape may be made from a single sheet of foldable material, the sheet in its flat unfolded condition having exactly the same outline as the sheets illustrated in FIG. 9 joined together along their side flaps or margins 50 and 51. Such a single sheet, twice the surface area of the sheet down in FIG. 9, is folded over itself so that its side flaps at the opposite ends may be superposed and stapled together.

Such a stool type seat is economical and easy to mass produce by stamping out the sheets. It is extremely easy to assemble and knock down and very compact and particularly light when it is made out of cardboard which makes it easily transportable when knocked down and laid out flat. The stool may also provide an excellent advertising medium as its moderate production cost permits distribution in very large quantities or even an extra chair or a child's play seat.

Of course the invention is not limited to the above disclosed embodiments, given by way of non-limiting examples, but it also covers all alternatives, equivalents and modifications within the scope of the appended claims.

What we claim is:

1. A knockdown seat in the form of a chair having a back comprising a seat member, a back member and a base member; said seat and back members being adapted to be supported by said base member and said base member being adapted to bear on the ground when said seat is assembled; said back and seat members each being formed of a single foldable semi-rigid sheet material element having complementary cutouts defining parts of joints for assembling said seat, each said single sheet material element comprising two parallel transverse hinges defining a central panel between two side flaps adapted to be folded toward each other to form a triangular prism; said base member comprising two side supports, each comprising a single foldable semi-rigid sheet material element adapted to bear edgewise and divided by four transverse hinges into five panels or flaps which are adapted to be folded spirally, said sheet material elements for said side supports having slots adapted to receive said flaps of said sheet material elements for said seat and back members to define said joints for interlocking said members together.

2. The seat according to claim 1, wherein edges of said sheet material elements for said side supports which are adapted to come into contact with said seat member and said back member when said seat is assembled each comprises, along a central panel, a steeply sloping portion continued by a slot and followed by a gradually sloping portion and then an oppositely sloping slot, and along two other panels, repetitions of one-half and four-fifths of said central panel edges, narrow flaps being disposed between said central panels and said other panels whereby when said side supports are spirally folded they appear like conventional chair sides.

3. The seat according to claim 1 or 2, wherein said sheet material elements for said back member and said seat member have along their short sides slots defining some of said parts of said joints, slots defining complementary parts of said joints being formed in edges of said sheet material elements for said side supports, said back member and said seat member being interlocked with said sheet material elements for said side supports by double sets of said joints.

* * * * *